US007409168B2

(12) United States Patent
Ochiai

(10) Patent No.: US 7,409,168 B2
(45) Date of Patent: Aug. 5, 2008

(54) IMAGE FORMING APPARATUS, PROCESS CARTRIDGE AND DEVELOPING METHOD

(75) Inventor: Norikazu Ochiai, Izu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 174 days.

(21) Appl. No.: 11/375,909

(22) Filed: Mar. 15, 2006

(65) Prior Publication Data

US 2007/0217797 A1 Sep. 20, 2007

(51) Int. Cl.
*G03G 15/08* (2006.01)
*G03G 15/06* (2006.01)

(52) U.S. Cl. ..... 399/27; 399/55

(58) Field of Classification Search ..... 399/24, 399/25, 27, 29, 53, 55
See application file for complete search history.

(56) References Cited

U.S. PATENT DOCUMENTS

2005/0191073 A1* 9/2005 Kawamura et al. ..... 399/55

FOREIGN PATENT DOCUMENTS

JP 2001-157686 12/2002

* cited by examiner

*Primary Examiner*—Hoang Ngo
(74) *Attorney, Agent, or Firm*—Amin, Turocy & Calvin, LLP

(57) ABSTRACT

Provided is a development technique of supplying a developing bias voltage having DC and AC components to a developing roller thereby to supply a developer to a photosensitive surface of a photosensitive material, which can contribute to improvement of the image quality of an image to be developed. The image forming apparatus, includes: a developing roller for supplying a developer to a photosensitive surface of a photosensitive material carrying an electrostatic latent image thereby to make the electrostatic latent image visible; and a voltage control unit for supplying a combination of a predetermined DC voltage and a predetermined AC voltage as a developing bias voltage to the developing roller as well as controlling the predetermined AC voltage so that a relation between a circumferential speed N of the developing roller and a frequency f of the AC voltage is as follows: $-0.097\times N+61.17 \leqq (f/N) \leqq -0.093\times N+67.33$.

20 Claims, 7 Drawing Sheets

FIG.5

| DEVELOPING ROLLER CIRCUMFERENTIAL SPEED | FREQUENCY | | | | | | |
|---|---|---|---|---|---|---|---|
| | 5kHz | 7kHz | 8kHz | 9kHz | 10kHz | 12kHz | 15kHz |
| 150mm/s | ○ | ○ | ○ | △ | △ | △ | △ |
| 300mm/s | – | ○ | ○ | ○ | ○ | ○ | △ |
| 400mm/s | – | – | – | ○ | ○ | ○ | △ |

IMAGE FORMING APPARATUS, PROCESS CARTRIDGE AND DEVELOPING METHOD

BACKGROUND OF THE INVENTION

1. Field of the Invention

The present invention relates to a development technique by which a developing roller is used to supply a developer to a photosensitive surface of a photosensitive material, and particularly it relates to a technique of suppressing toner adhering to an out-of-image portion in dust, i.e. the occurrence of a so-called image fouling.

2. Description of the Related Art

As for a development technique of using a developing roller to supply a developer to a photosensitive surface of a photosensitive material thereby to make an electrostatic latent image formed on the photosensitive surface visible, there has been known a technique of supplying a developing bias voltage having DC and AC components to the developing roller conventionally. The DC component of a developing bias voltage herein serves to make the developer adhere to the photosensitive surface. Also, the AC component of the developing bias voltage herein serves to force the developer adhering to the photosensitive surface to vibrate thereby to make clear the boundary between a region in the photosensitive surface where an electrostatic latent image is formed and a region with no latent image formed therein.

Conventionally, there has been known a technique such that a frequency range of AC component is set to the peak voltage value width of AC component or larger, for example, 1500 Hz or higher when the peak voltage Vp-p is set to 1500V, thereby to suppress the image fouling and improve the quality of an image (JP-A-2002-351198).

Further, when e.g. a circumferential speed N of a developing roller (magroller) is 300 mm/sec in the case where 10000 Hz is used at the time of a normal speed, the AC component reciprocates 100/3 times per millimeter. Therefore, there has been known a technique that in reducing the speed to 150 mm/sec while maintaining the relation, 100/3×150=5000 Hz and as such, the frequency is used for slowdown.

However, as in JP-A-2002-351198, in the case where the frequency f is set to 1500 Hz or higher when the peak voltage Vp-p is set to 1500V, the upper limit in setting the frequency is lost. In the case where there is no upper limit for the frequency, a phenomenon that an image and a character are dissipated on a photosensitive material when the frequency is excessively high will be caused. Further, in the case where the frequency is set to 1200 Hz when the peak voltage Vp-p is 1200V, "fouling characteristic" is not made satisfying. Satisfying "fouling characteristic" can not be achieved until the frequency is set to be a high frequency of 10000 Hz or higher. In other words, fouling characteristic can not be made satisfying until the frequency is made higher than the frequency lower limit condition defined in the above-described conventional technique (JP-A-2002-351198).

Further, in the case where the frequency of AC voltage is set to 10000 Hz when the circumferential speed N of the developing roller is 300 mm/sec and the fouling characteristic is satisfying with no dust, using the frequency, 100/3*150=5000 Hz, in reducing the circumferential speed N to 150 mm/s while maintaining a relation such that the AC component reciprocates 100/3 times per millimeter of the developing roller worsens the fouling characteristic. Moreover, in such case, a satisfying fouling characteristic can not be achieved until the frequency is set to a higher one. Still further, increasing the frequency of the developing bias voltage excessively increases the reciprocating motion (vibration) of the developer on the photosensitive surface and causes an image formed on the photosensitive surface by the developer to be dissipated, which can lead to degradation of image quality.

SUMMARY OF THE INVENTION

The invention was made to solve the above-described problems. It is an object of the invention to provide a development technique of supplying a developing bias voltage having DC and AC components to a developing roller thereby to supply a developer to a photosensitive surface of a photosensitive material, which can contribute to improvement of the image quality of an image to be developed.

In order to solve the above-described problems, an image forming apparatus according to an embodiment of the invention has a configuration characterized by including: a developing roller for supplying a developer to a photosensitive surface of a photosensitive material carrying an electrostatic latent image thereby to make the electrostatic latent image visible; and a voltage control unit for supplying a combination of a predetermined DC voltage and a predetermined AC voltage as a developing bias voltage to the developing roller as well as controlling the predetermined AC voltage so that a relation between a circumferential speed N of the developing roller and a frequency f of the AC voltage is as follows: $-0.097\times N+61.17 \leqq (f/N) \leqq -0.093\times N+67.33$.

In order to solve the above-described problems, an image forming apparatus according to an embodiment of the invention has a configuration characterized by including: a developing means for making an electrostatic latent image visible; and a voltage control means for supplying a combination of a predetermined DC voltage and a predetermined AC voltage as a developing bias voltage to the developing roller as well as controlling the predetermined AC voltage so that a relation between a circumferential speed N of the developing roller and a frequency f of the AC voltage is as follows: $-0.097\times N+61.17 \leqq (f/N) \leqq -0.093\times N+67.33$.

In order to solve the above-described problems, a process cartridge according to the invention is a process cartridge which can be attached to and removed from an image forming apparatus for forming an image on a sheet, and has a configuration characterized by including: an image forming apparatus having a configuration as described above; and at least one of a photosensitive material for carrying an electrostatic latent image, a charging unit for electrifying a photosensitive surface of the photosensitive material, and a cleaner for removing a developer remaining on the photosensitive surface of the photosensitive material.

In order to solve the above-described problems, a developing method according to the invention is a developing method for a developing apparatus including a developing roller for supplying a developer to a photosensitive surface of a photosensitive material carrying an electrostatic latent image thereby to make the electrostatic latent image visible, and a voltage control unit for supplying a combination of a predetermined DC voltage and a predetermined AC voltage as a developing bias voltage to the developing roller, and has a configuration characterized by including: a condition-judging step for judging a predetermined condition in which fouling characteristic worsens in the developing apparatus; and a voltage control step for controlling the predetermined AC voltage so that a relation between a circumferential speed N of the developing roller and a frequency f of the AC voltage is as follows when it is judged in the condition-judging step that the predetermined condition is satisfied:

$$-0.097\times N+61.17\leqq(f/N)\leqq-0.093\times N+67.33.$$

DESCRIPTION OF THE DRAWINGS

FIG. 5 is a view showing the relation between the frequency and dust on an image.

DESCRIPTION OF THE EMBODIMENTS

A form of an image forming apparatus with a developing apparatus according to the embodiment will be described below with reference to the drawings. Herein, the image forming apparatus according to the embodiment is constituted by e.g. MFP (Multi Function Peripheral).

Figure 1:
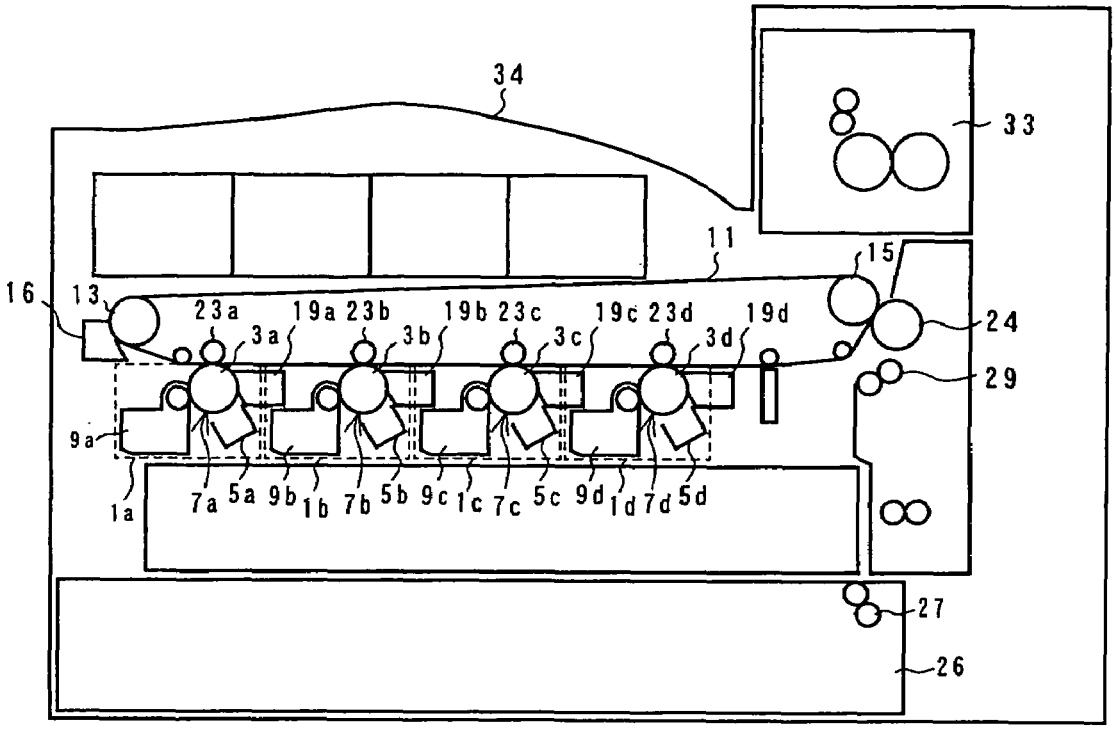
FIG. 1 is a sectional view showing a configuration of an image forming apparatus with a developing apparatus according to the embodiment.
Figure 2:
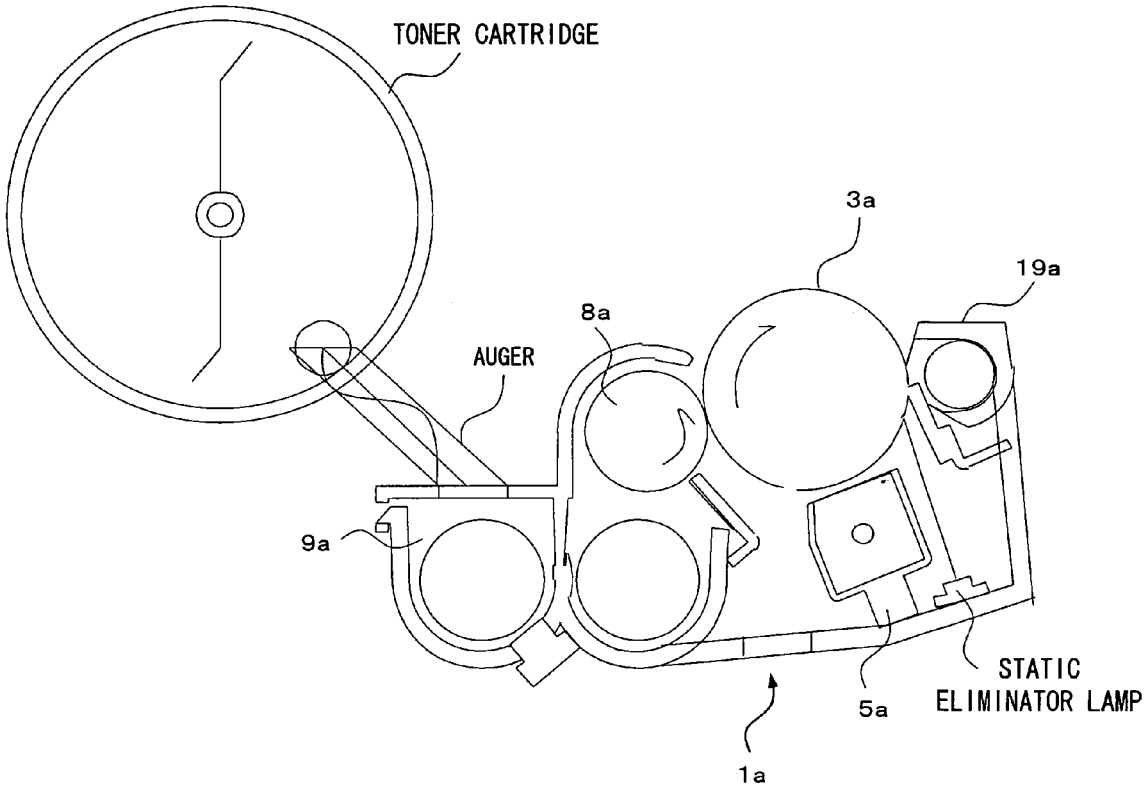
FIG. 2 is a sectional view showing a configuration around a process cartridge according to the embodiment.

FIG. 1 is a sectional view showing a configuration of the image forming apparatus with the developing apparatus according to the embodiment. FIG. 2 is a sectional view showing a configuration around a process cartridge according to the embodiment.

As shown in FIG. 1, the image forming apparatus according to the embodiment includes process cartridges 1*a*, 1*b*, 1*c* and 1*d* as image-forming means.

The process cartridges have photoreceptor drums 3*a*, 3*b*, 3*c* and 3*d* as an image-carrier, and a developer image is formed on the photosensitive material thereof.

In FIG. 2, the photoreceptor drum 3*a* is in the shape of a cylinder having a diameter of 30 mm and provided rotatably in the direction of the arrow shown in the drawing.

The following are arranged along the direction of the rotation around the photoreceptor drum 3*a*. First, an electrification charger (a charging unit) 5*a* is provided facing a surface of the photoreceptor drum 3*a*. The electrification charger 5*a* electrifies the photoreceptor drum 3*a* negatively and uniformly. An exposure apparatus for exposing the electrified photoreceptor drum 3*a* to form an electrostatic latent image is provided downstream of the electrification charger 5*a* (on the right hand in FIG. 1). In addition a developing unit 9*a* is provided downstream of the exposure apparatus, which has a yellow-colored (yellow) developer kept therein and uses the developer to perform reversing development of an electrostatic latent image formed by the exposure apparatus. The developing unit 9*a* has a developing roller 8*a* (developing means) mounted therein, which supplies a developer to a photosensitive surface of the photoreceptor drum 3*a* carrying an electrostatic latent image thereby to make the electrostatic latent image visible. A middle-transfer belt 11, which is an image-formed medium, is mounted so as to bear on the photoreceptor drum 3*a*.

Downstream of a place where the belt 11 abuts on the photoreceptor drum 3*a*, a cleaner 19*a* is provided. The cleaner 19*a* removes and retrieves residual toner on the photosensitive material after the transfer. A static eliminator lamp eliminates static charge on a surface of the photoreceptor drum 3*a* by uniform light irradiation. Thus, one cycle of image formation is completed, and again the electrification charger 5*a* uniformly electrifies the unelectrified photoreceptor drum 3*a* in a subsequent image formation process.

As shown in FIG. 2, the process cartridge 1*a* is integrally made up of the photoreceptor drum 3*a*, the electrification charger 5*a*, the developing unit 9*a* and the cleaner 19*a*, as a cartridge, and it can be attached to and removed from the apparatus body freely.

The middle-transfer belt 11 has a length (width) substantially equal to a dimension of length of the photoreceptor drum 1*a* in a direction orthogonal to the direction of transportation (direction of the arrow e shown in the drawing). The belt 11 has the shape of an endless (seamless) belt, and is carried on a driving roller 15 for forcing the belt to circle at a predetermined speed and some driven rollers.

The belt 11 is formed from a 100 μm-thick polyimide with carbon uniformly distributed therein. The belt 11 has an electrical resistivity of 10^9Ω, and exhibits semiconductivity.

A material for the belt 11 may be a material which has a volume resistance value of 10^ to 10^11 Ωcm and exhibits semiconductivity. In addition to polyimide with carbon uniformly distributed therein, such material may be, for example, polyethylene terephthalate, polycarbonate, polytetrafluoroethylene, polyvinylidene fluoride and others, in which electroconductive particles of carbon or the like are distributed. Otherwise, a polymer film, whose electrical resistance is adjusted by composition adjustment instead of use of electroconductive particles, may be used. Further, a polymer film like this may be mixed with an ionic conductive substance, or may be made of a rubber material of silicon rubber, urethane rubber or the like, which is relatively low in its electrical resistance.

On the belt 11 are arranged the process cartridges 1*b*, 1*c* and 1*d* in addition to the process cartridge 1*a* along the direction of transportation of the belt 11 between the driving roller 13 and the secondary transfer opposite roller 13.

Any of the process cartridges 1*b*, 1*c* and 1*d* has the same configuration as the process cartridge 1*a*. That is, the photoreceptor drums 1*b*, 1*c* and 1*d* are provided in substantially central portions of the respective process cartridges. Electrification chargers 5*b*, 5*c* and 5*d* are provided around the photoreceptor drums, respectively. Also, their configuration in which developing units 9*b*, 9*c* and 9*d* and cleaners 19*b*, 19*c* and 19*d* are provided downstream of the respective electrification chargers is the same as that of the process cartridge 1*a*. They are different from the process cartridge 1*a* in developers kept in the developing units. The developing unit 19*b* keeps a magenta developer. The developing unit 19*c* keeps a cyan developer. The developing unit 19*d* keeps a black developer.

The belt 11 abuts on the individual photoreceptor drums sequentially.

In the vicinities of the places where the belt 11 abuts on the individual photoreceptor drums, transfer apparatuses 23*a*, 23*b*, 23*c* and 23*d* as transfer means are provided corresponding to the respective photoreceptor drums. The is, each transfer apparatus 23 is provided above the corresponding photoreceptor drum with its rear surface in contact with the belt 11 and opposed to the process cartridge through the belt 11.

The transfer member 23*a* is connected to a voltage-applying means, i.e. a DC power source 25*a* which is positive (+), not shown in the drawing. Likewise, the transfer members 23*b*, 23*c* and 23*d* are connected to the DC power sources 25*b*, 25*c* and 25*d* respectively, which are not shown in the drawing.

On the other hand, a paper-feed cassette 26 for stocking a paper sheet P is provided in a lower portion of the image forming portion in FIG. 1. In the body of the image forming apparatus, a pickup roller 27 for picking up a paper sheet P one by one from the paper-feed cassette 26 is provided. Near the secondary transfer roller, a pair of resist rollers 29 is provided rotatably. The pair of resist rollers 29 supplies a paper sheet P, with a predetermined timing, to a secondary transfer portion where the secondary transfer roller 24 and the secondary transfer opposite roller 13 are confronted each other with the belt sandwiched therebetween.

Further, in FIG. 1, there are also provided a fixing unit 33 for fixing the developer on a paper sheet and a paper-ejecting portion 34 to which a paper sheet P subjected to the fixation by the fixing unit is ejected.

The color image forming operation of the image forming apparatus configured as described above will be described. When start of image formation is directed, the photoreceptor drum 3*a* starts rotating in response to a driving force from a driving mechanism (not shown). The electrification charger 5*a* electrifies uniformly the photoreceptor drum 3*a* to −600V approximately. The exposure apparatus 7*a* irradiates the photoreceptor drum 3*a*, which has been uniformly electrified by the electrification charger 5*a*, with light according to an image to be recorded, and then forms an electrostatic latent image. The developing unit 9*a* keeps a developer (yellow (Y) toner+ferrite carrier: binary developer) therein. The developing unit 9*a* uses a developing bias power source (not shown) to provide a bias with a value of −380V to a developing sleeve (not shown) to form an electric field for development between the photosensitive drum 3*a* and itself. The negatively electrified Y toner adheres to a region of an image portion potential (high potential portion: its sign is considered here) of an electrostatic latent image of the photosensitive material 3*a* in reversing development.

Subsequently, the developing unit 9*b* uses a magenta developer to develop an electrostatic latent image and forms a magenta toner (M toner) image on the photosensitive drum 3*b*. In this case, M toner has an average particle size of about 7 μm like Y toner, and is negatively electrified by triboelectric charging with ferrite magnetic carrier particles (not shown) with an average particle size of about 60 μm. The value of a developing bias is about −380V as in the case of the developing unit 3*a*, which is applied to the developing sleeve (the configuration of the developing unit is the same as that of the developing unit 9*a*) by the bias power source (not shown). As for the direction of the electric field for development, it runs from the surface of the photosensitive drum 3*b* toward the developing sleeve in an image portion; the negatively electrified M toner adheres to a high potential portion of a latent image.

In a transfer region Ta formed by the photoreceptor drum 3*a*, the belt 11, and the transfer member 23*a*, a bias voltage of about +1000V is applied to the transfer member 23*a*. A transfer electric field is formed between the transfer member 23*a* and the photoreceptor drum 3*a*; a yellow toner image on the photoreceptor drum 3*a* is transferred onto the belt 11 according to the transfer electric field. In this way, a magenta developer image, a cyan developer image and a black developer image are superposed on a Y (yellow) toner developer image and then multi-transferred thereto in turn. On the other hand, the pickup roller 27 picks up a paper sheet P out of the paper-feed cassette 26, and the pair of resist rollers 29 feeds the paper sheet P into the secondary transfer portion.

In the secondary transfer portion, a predetermined bias is applied to the secondary transfer opposite roller to form a transfer electric field between the secondary transfer roller and the its opposite roller with the belt sandwiched therebetween, whereby multicolor toner images on the belt 11 are transferred to a paper sheet P collectively. The developer images of the respective colors thus transferred at a time are fixed on the paper sheet P by the fixing unit 33, whereby a color image is formed. The paper sheet P after the fixing is ejected onto the paper-ejecting portion 34.

Figure 3:
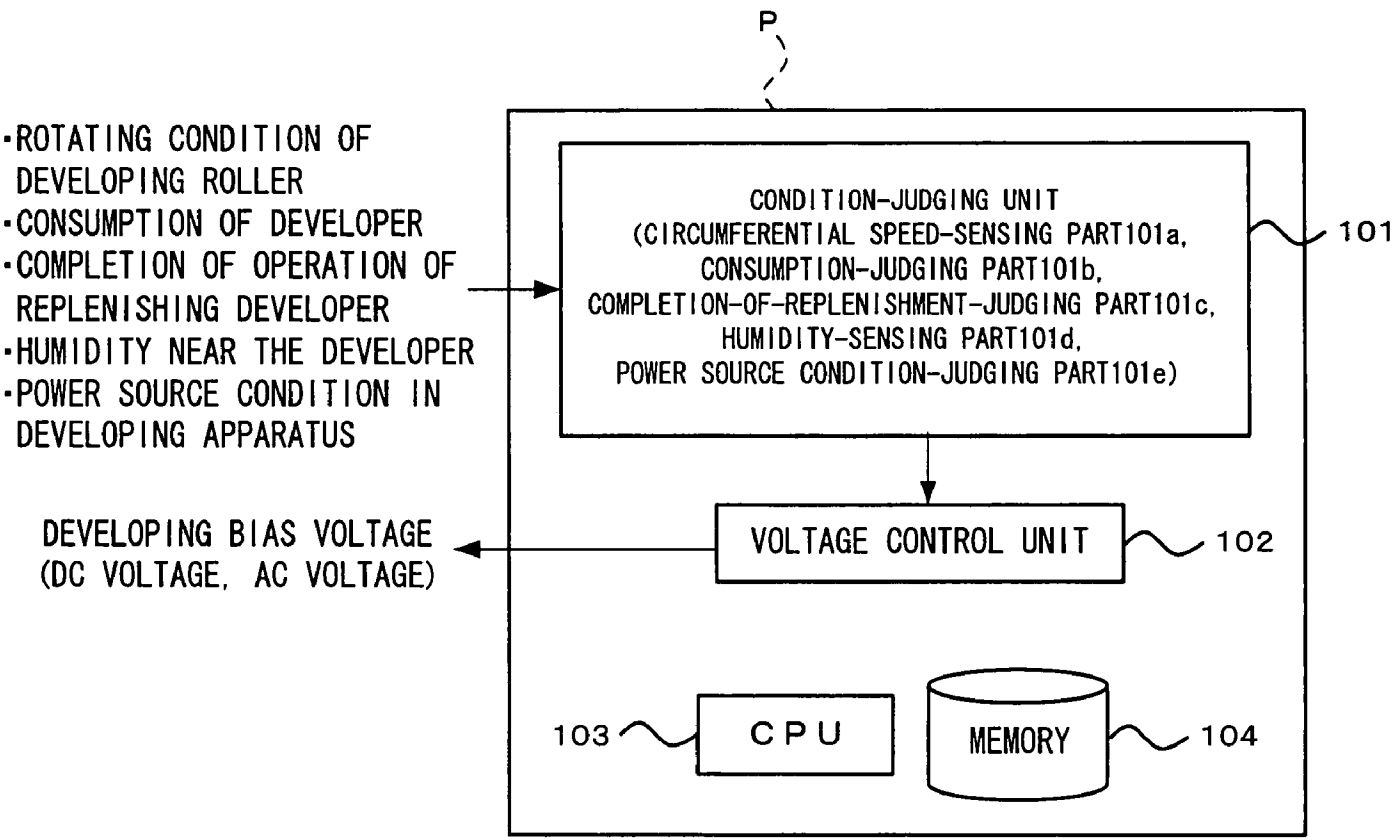
FIG. 3 is a functional block diagram for explanation on a configuration of a developing apparatus P according to the embodiment.

FIG. 3 is a functional block diagram for explanation on a configuration of a developing apparatus P according to the embodiment. The developing apparatus P according to the embodiment has a configuration that it includes a condition-judging unit 101, a voltage control unit 102, a CPU 103, and a MEMORY 104.

The condition-judging unit 101 includes: a circumferential speed-sensing part 101*a*; a consumption-judging part 101*b*; a completion-of-replenishment-judging part 101*c*; a humidity-sensing part 101*d*; and a power source condition-judging part 101*e*. The condition-judging unit 101 judges a predetermined condition in which the fouling characteristic worsens in the developing apparatus P.

Incidentally, the circumferential speed-sensing part 101*a* judges the rotating condition of the developing roller. The consumption-judging part 101*b* judges the consumption of the developer for an image formed with respect to a photosensitive surface. The completion-of-replenishment-judging part 101*c* judges the completion of the operation of replenishing the developer for supply to the photosensitive surface by the developing roller. The humidity-sensing part 101*d* senses the humidity in the vicinity of the developer supplied to the photosensitive surface at least by the developing roller. The power source condition-judging part 101*e* judges a condition of the power source in the developing apparatus.

When it is judged in the condition-judging unit 101 that a predetermined condition is satisfied, the voltage control unit 102 supplies a combination of a predetermined DC voltage and a predetermined AC voltage as a developing bias voltage to the developing roller, and controls the predetermined AC voltage so that the relation between the circumferential speed N of the developing roller and the frequency f of the AC voltage is as follows:

$$-0.097\times N+61.17 \leqq (f/N) \leqq -0.093\times N+67.33$$

Specifically, the voltage control unit 102 controls the predetermined AC voltage as described above in the following cases; when the circumferential speed of the developing roller sensed by the circumferential speed-sensing part 101*a* is equal to or below a predetermined circumferential speed; when the consumption of the developer judged by the consumption-judging part 101*b* exceeds a predetermined threshold; when it is judged in the completion-of-replenishment-judging part 101*c* that replenishment of the developer has been completed; when the humidity sensed by the humidity-sensing part 101*d* exceeds a predetermined threshold (e.g. 60% in absolute humidity); or when it is judged in the power source condition-judging part 101*e* that the power source of the developing apparatus has been in OFF state for a predetermined period (e.g. one week) or a longer time. In addition, the above-described control may be made in a season during which the fouling characteristic is easy to worsen and in a use area where the fouling characteristic is easy to worsen.

CPU 103 serves to perform various processes in the developing apparatus. Also, CPU 103 serves to execute a program stored in MEMORY 104 thereby to actualize the various functions. MEMORY 104 is composed of e.g. HDD, ROM or RAM, and serves to store various pieces of information and programs, which are utilized in the developing apparatus.

Figure 4:
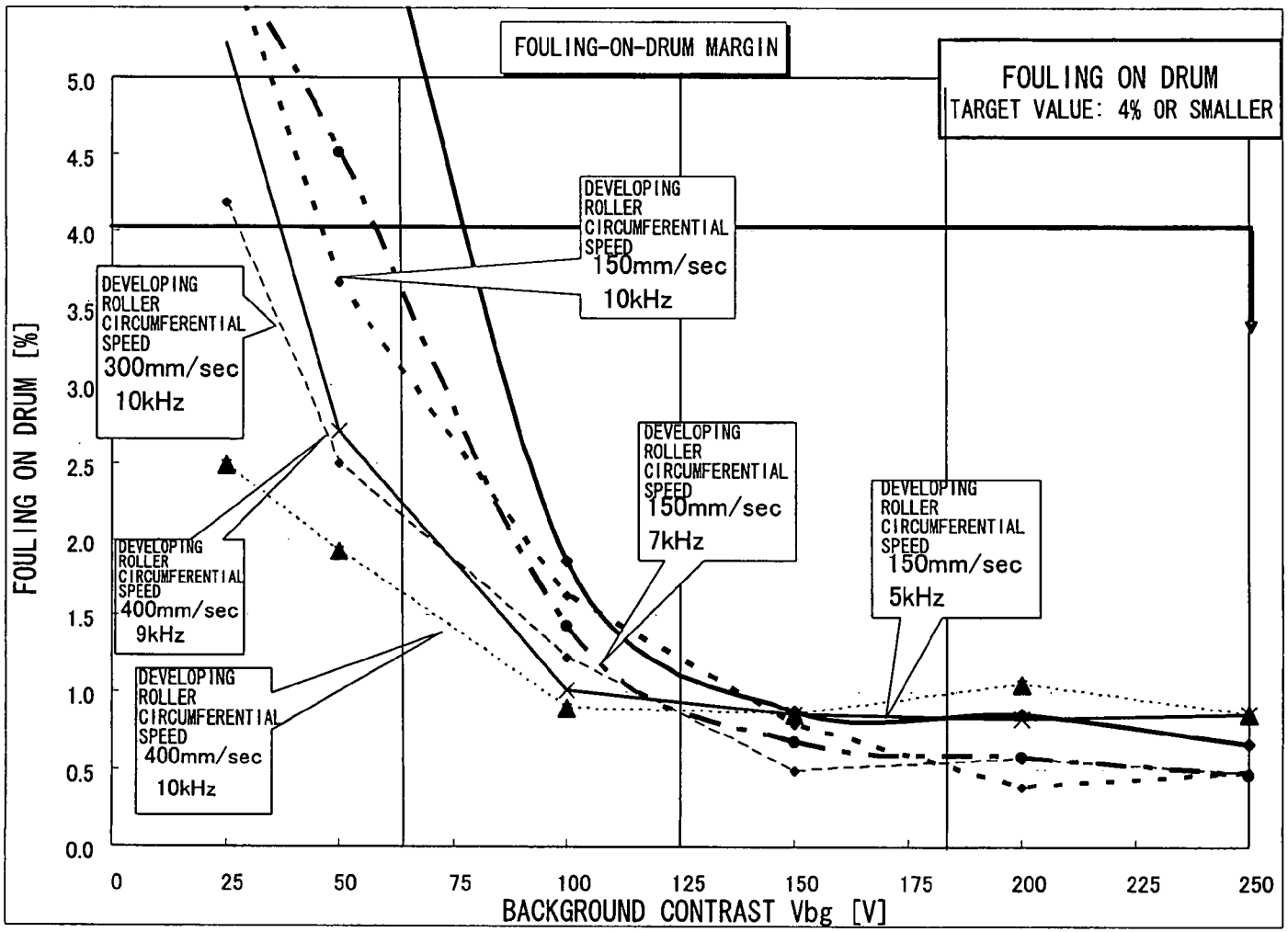
FIG. 4 is a graph showing a fouling characteristic in the cases where the circumferential speed of the developing roller and the frequency are changed.

Subsequently, the effect resulting from control of the developing bias voltage in the developing apparatus according to the embodiment will be described. FIG. 4 is a graph showing "Fouling Characteristic (which represents easiness of occurrence of image fouling)" in the cases where the circumferential speed of the developing roller and the frequency are changed. The horizontal axis takes the difference between an electrification potential of the photosensitive material of a white background portion and a potential applied to the developing roller (hereinafter referred to as background contrast potential); the vertical axis takes a value taken by unsticking toner, which adheres to the photosensitive material of a white background portion downstream of a toner supply portion of the photosensitive material and the developing roller, by a piece of tape, and then measuring the reflectivity of the piece of tape.

A region where the background contrast potential is within 125+60(V) is a range in which the background contrast potential is changed. The fouling characteristic is regarded as being in a satisfying condition when the reflectivity takes on a value equal to or below 4% in the range.

From FIG. 4, when the circumferential speed of the developing roller is 300 mm/sec, the fouling characteristic falls in a satisfying range at 10000 Hz. In the case where the circumferential speed of the developing roller is 150 mm/sec, the fouling characteristic is in an unsatisfying range at a frequency of 5000 Hz, but it falls in a satisfying range from a frequency of 7000 Hz, and the fouling characteristic is more satisfying at 10000 Hz. When the circumferential speed of the developing roller is 400 mm/sec, the fouling characteristic falls in a satisfying range at 9000 Hz and 10000 Hz.

It is seen from the characteristic of the graph at 150 mm/sec that the fouling characteristic is made better as the frequency is increased. Though the toner is influenced by an AC component, a little toner reciprocates because of a high frequency. The toner vibrates in a portion to which it is attracted by a potential of a DC component, whereas the toner is attracted by the potential of a DC component from the photosensitive material toward the developing roller in a portion where there is no latent image on the photosensitive material and as such, the fouling becomes satisfying.

The toner is distributed in its mass and quantity of electrification. Therefore, the toner includes an aggregate of toner having a large mass and an aggregate of toner having a small mass, and an aggregate with a large quantity of electrification and an aggregate with a small quantity of electrification. Also, the toner includes an aggregate of toner which is influenced by the potential easily and an aggregate of toner which is less influenced by the potential. Further, the toner includes an aggregate of toner which is made to reciprocate and an aggregate of toner which is made to reciprocate little, but vibrate. However, as the frequency is made higher, the amount of toner which reciprocates is reduced and the amount of toner which vibrates in the potential field is increased.

Making a comparison between the cases of the same frequency, 10000 Hz, it is seen that as the circumferential speed of the developing roller is made higher, such as from 150 mm/sec to 300 mm/sec and further to 400 mm/sec, the fouling characteristic is made better. The reason for this can be considered as follows: the time during which the toner is in contact with the photosensitive material is made longer and as such, the toner is made easier to adhere owing to the intermolecular force. Therefore, with a common frequency, the developing roller's frequency per millimeter is made higher when the speed is slowed, but beyond that, the time during which the toner is in contact with the photosensitive material is made longer and as such, the image is made easier to foul.

In the condition where the developing roller's frequency per millimeter is made common, when a comparison is made between the cases of 150 mm/sec at 5000 Hz and 300 mm/sec at 10000 Hz, the fouling characteristic worsens in the case of 150 mm/sec at 5000 Hz. The reason for this can be considered as follows: the time during which the toner is in contact with the photosensitive material is longer in the case of 150 mm/sec and as such, the intermolecular force is made stronger and the toner is made easier to adhere. Therefore, in the case of 150 mm/sec, unless the developing roller's frequency per millimeter is increased to 7000 Hz or higher, the fouling characteristic doesn't reach a satisfying region.

FIG. 5 is a view showing the relation between the frequency and dust on an image. In the drawing, "Open Circle" shows a satisfying condition where the quantity of dust image is small; "Triangle" shows an unsatisfying condition where a dust image appears. As the developing roller's frequency per millimeter is made higher, "Dust Image" appears, which makes unclear the boundary between a region in which an image should be formed and a region in which any image should not be formed. The reason for this can be considered as follows: on a downstream side of a latent image of the photosensitive material, the toner on the developing roller facing a portion on the downstream side is applied with a high frequency, whereby both a force of attracting from the latent image portion and a force of attracting onto the developing roller are exerted at the boundary of the latent image portion, and thus the quantity of toner suspending in a space between the latent image portion and the developing roller is increased. When the frequency is made a low frequency, the suspending toner is made prone to reciprocate toward either the latent image portion of the photosensitive material or an upper portion of the developing roller and as such, the toner tends to adhere to either the latent image portion or the developing roller. As a result, the quantity of the suspending toner is reduced. Thus, when the frequency is too high, toner suspending downstream of the latent image appears; such toner disturbs an image as dust when the toner adheres to a portion other than the latent image downstream of the latent image.

Figure 6:
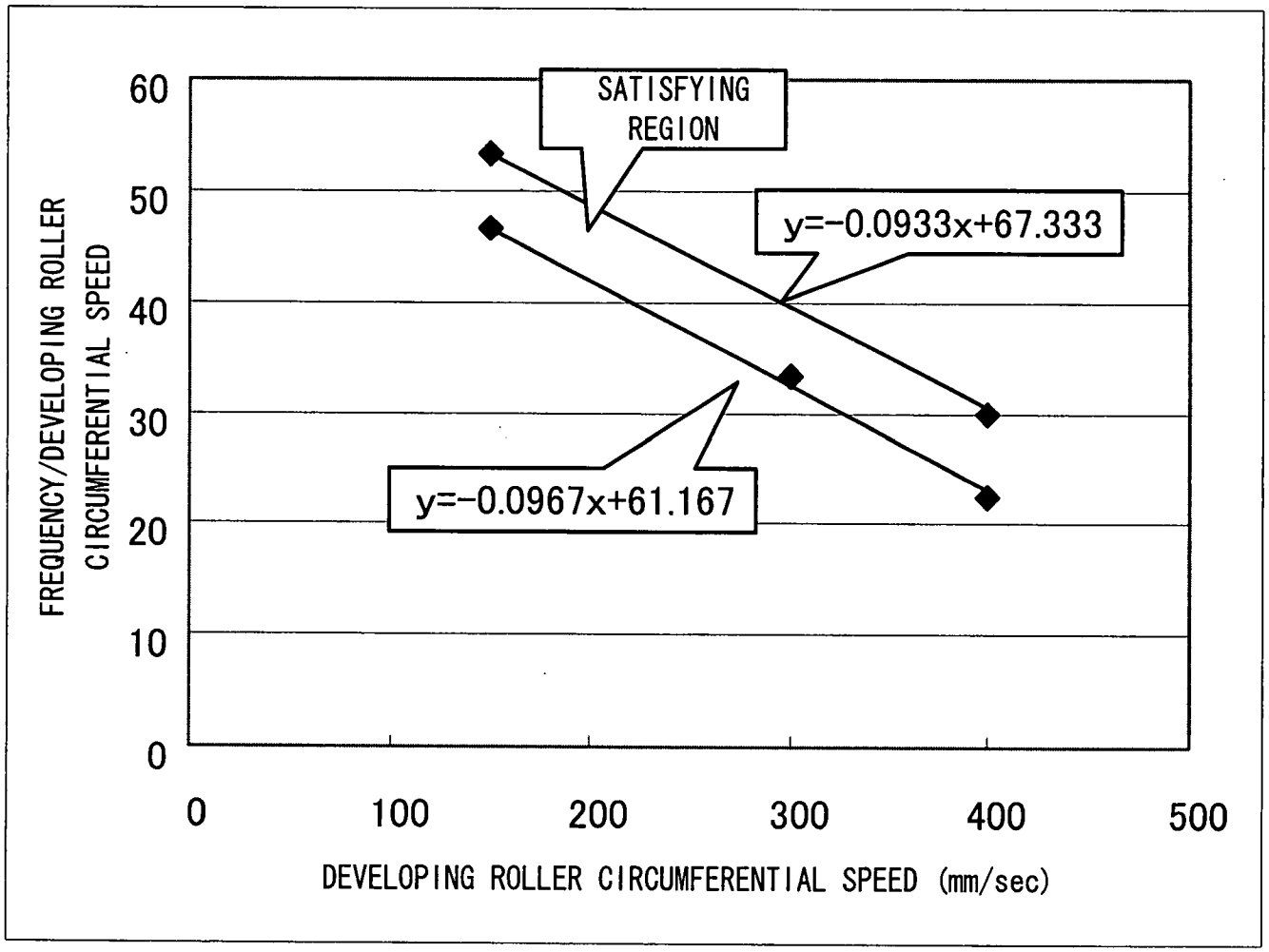
FIG. 6 is a graph showing a region which can satisfy both the condition for the fouling characteristic and the condition for the dust image.

FIG. 6 is a graph showing a region which can satisfy both the condition for the fouling characteristic and the condition for the dust image. From FIGS. 4 and 5, the following cases were satisfying conditions: the satisfying frequency is 7000-8000 Hz when the developing roller circumferential speed is 150 mm/sec; the frequency is 10000-12000 Hz when the developing roller circumferential speed is 300 mm/sec; and the frequency is 9000-12000 Hz when developing roller circumferential speed is 400 mm/sec. A region which satisfies the fouling characteristic and in which no dust image appears can be shown by the following expression:

$$-0.097\times N+61.17 \leqq (f/N) \leqq -0.093\times N+67.33 \quad (1)$$

Figure 7:
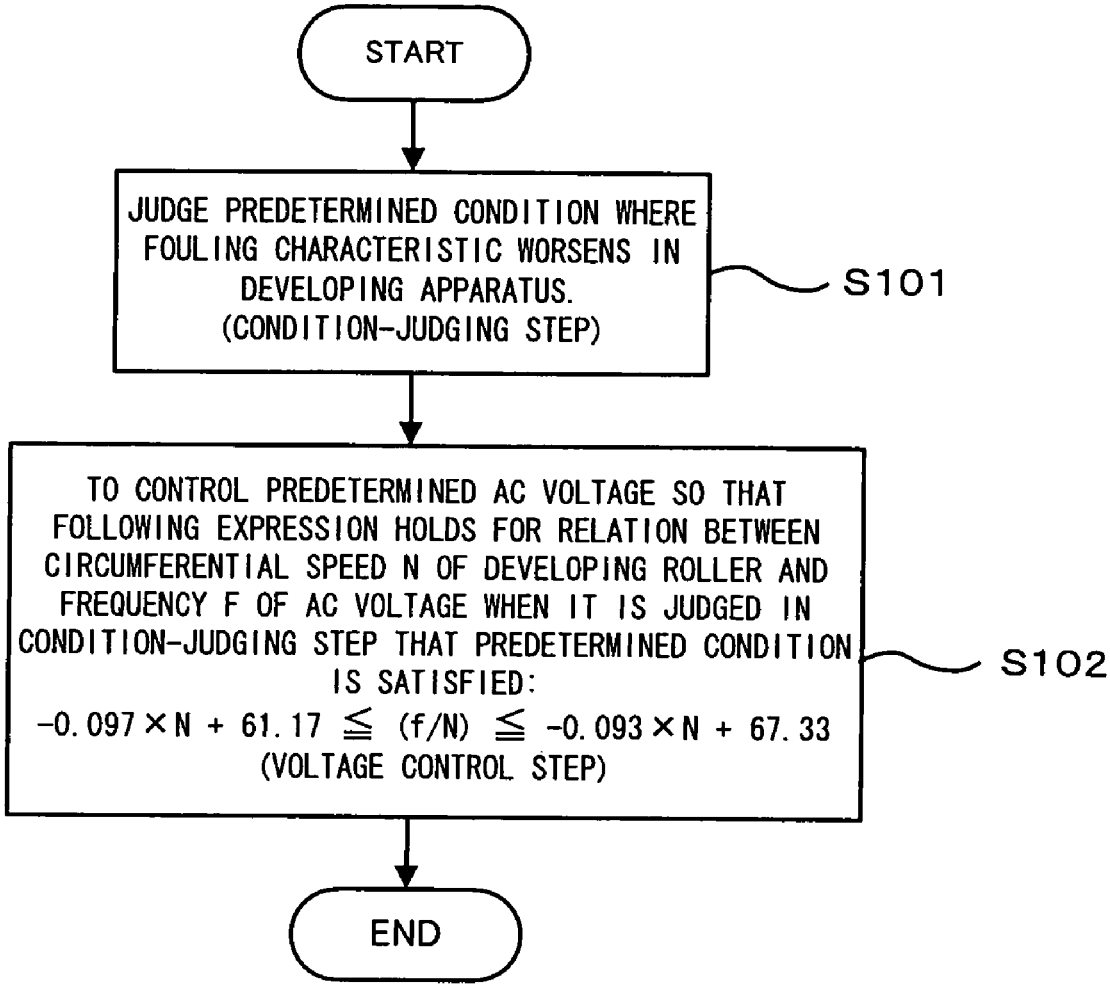
FIG. 7 is a flowchart showing the outline of the flow of a process (developing method) in the developing apparatus according to the embodiment.

FIG. 7 is a flowchart showing the outline of the flow of a process (developing method) in the developing apparatus according to the embodiment.

The condition-judging unit 101 judges a predetermined condition in which the fouling characteristic worsens in the developing apparatus (Condition-judging step) (S101).

Specifically, the condition-judging step includes: judging the rotating condition of the developing roller; judging the consumption of the developer for an image formed on a photosensitive surface; judging completion of the operation of replenishing the developer for supply to the photosensitive surface by the developing roller; sensing the humidity in the vicinity of the developer supplied to the photosensitive surface at least by the developing roller; and judging the condition of the power source in the developing apparatus.

In the case where it is judged in the condition-judging step that the predetermined condition is satisfied, the voltage control unit 102 controls a predetermined AC voltage so that the relation between the circumferential speed N of the developing roller and the frequency f of the AC voltage is as follows (Voltage control step) (S102):

$$-0.097\times N+61.17\leqq(f/N)\leqq-0.093\times N+67.33.$$

When it is judged in the condition-judging step that the circumferential speed of the developing roller is equal to or smaller than the predetermined circumferential speed, in the voltage control step, the relation between the circumferential speed N of the developing roller and the frequency f of the AC voltage is set as described above in the following cases; when the consumption of the developer judged in the condition-judging step to exceed the predetermined threshold; when it is judged in the condition-judging step that replenishment of the developer has been completed; when the humidity sensed in the condition-judging step exceeds the predetermined threshold; or when it is judged in the condition-judging step that the power source of the developing apparatus has been in OFF state for the predetermined period or a longer time.

The above-described steps in the process (developing method) in the developing apparatus are implemented by making CPU 103 execute a developing program stored in MEMORY 104.

In the embodiment, the case where a function for embodying the invention is previously recorded inside the apparatus has been described. However, the invention is not so limited, the same function may be downloaded from a network to the apparatus, or the same function recorded in a recording medium may be installed on the apparatus. The recording medium may have any form as long as it is a recording medium such as a CD-ROM which a program can be held in and the apparatus can read. Also, the function previously obtained through installation or download like this may be actualized by cooperation with OS (Operating System) inside the apparatus.

In the above-described embodiment, the arrangement in that the frequency of an AC voltage as the developing bias voltage is set within a predetermined range. However, the invention is not so limited. For example, it is needless to say that the same effect can be achieved by setting the peak voltage of the AC voltage to an optimal value.

Therefore, according to the embodiment, when the frequency of AC voltage of the developing bias voltage is made a high frequency equal to or above the lower limit in Expression (1), despite the fact that toner is influenced by the AC component, the amount of reciprocating toner is small because of the high frequency, and the toner vibrates in a portion to which the toner is attracted by the potential of the DC component and it is attracted by the potential of DC component from the photosensitive material side toward the developing roller side in a portion in which there is no latent image on the photosensitive material. As a result, the fouling condition is made better.

In general, when the frequency of AC voltage of the developing bias voltage is made a low frequency, the suspending toner is made prone to reciprocate toward either the latent image portion of the photosensitive material or an upper portion of the developing roller and as such, the toner tends to adhere to either the latent image portion or the developing roller. As a result, the quantity of the suspending toner is reduced. Thus, when the frequency is too high, toner suspending downstream of the latent image appears; such toner disturbs an image as dust when the toner adheres to a portion other than the latent image downstream of the latent image.

Hence, when the frequency is made a frequency equal to or below the upper limit in Expression (1), it becomes possible to avoid the following situation: on a downstream side of a latent image of the photosensitive material, the toner on the developing roller facing a portion on the downstream side is applied with a high frequency, whereby both a force of attracting from the latent image portion and a force of attracting onto the developing roller are exerted at the boundary of the latent image portion, and thus the quantity of toner suspending in a space between the latent image portion and the developing roller is increased.

Detail of the invention has been described based on the particular embodiment. However, it will be obvious to those skilled in the art that various changes and modifications may be made without departing from the spirit and scope of the invention.

As described above in detail, the invention can provide a development technique of supplying a developing bias voltage having DC and AC components to a developing roller thereby to supply a developer to a photosensitive surface of a photosensitive material, which can contribute to improvement of the image quality of an image to be developed.

What is claimed is:

1. An image forming apparatus, comprising:

an image carrier configured to carry an electrostatic latent image;

a developing device configured to contain a developer, the developing device including a developing roller that supplies the developer to the image carrier to make the electrostatic latent image visible;

a condition judging unit configured to make a judgment about a condition of the developing device; and a voltage control unit configured to supply a combination of a DC voltage and a AC voltage as a developing bias voltage to the developing roller and configured to change the AC voltage according to the judgment so that a relation between a circumferential speed N of the developing roller and a frequency f of the AC voltage is as follows:

$$-0.097\times N+61.17\leqq(f/N)\leqq-0.093\times N+67.33.$$

2. The image forming apparatus of claim 1, wherein the condition judging unit makes the judgment based on a rotating condition of the developing roller, and the voltage control unit sets the relation between a circumferential speed N of the developing roller and a frequency f of the AC voltage so that the following expression holds when the circumferential speed of the developing roller according to the judgement is equal to or below a predetermined circumferential speed:

$$-0.097\times N+61.17\leqq(f/N)\leqq-0.093\times N+67.33.$$

3. The image forming apparatus of claim 1, wherein the condition judging unit makes the judgment based on a consumption of the developer, and the voltage control unit sets the relation between a circumferential speed N of the developing roller and a frequency f of the AC voltage so that the following expression holds when the consumption of the developer according to the judgment exceeds a predetermined threshold:

$$-0.097\times N+61.17\leqq(f/N)\leqq-0.093\times N+67.33.$$

4. The image forming apparatus of claim 1, wherein the condition judging unit makes the judgment based on a completion of an operation of a replenishment the developer with the developing device, and the voltage control unit keeps the relation between a circumferential speed N of the developing roller and a frequency f of the AC voltage set so that the following expression holds until a predetermined period elapses when the judgment stands for that the replenishment has been completed:

$$-0.097\times N+61.17\leqq(f/N)\leqq-0.093\times N+67.33.$$

5. The image forming apparatus of claim 1, wherein the condition judging unit makes the judgment based on a humidity in a vicinity of the developer supplied to the image carrier at least by the developing roller, and the voltage control unit sets the relation between a circumferential speed N of the developing roller and a frequency f of the AC voltage so that the following expression holds when the humidity according to the judgment exceeds a predetermined threshold:

$$-0.097\times N+61.17\leqq(f/N)\leqq-0.093\times N+67.33.$$

6. The image forming apparatus of claim 1, wherein the condition judging unit makes the judgment based on a condition of a power source in the image forming apparatus, and the voltage control unit sets the relation between a circumferential speed N of the developing roller and a frequency f of the AC voltage so that the following expression holds when the judgment stands for that the power source has been in OFF state for a predetermined period or a longer time:

$$-0.097\times N+61.17\leqq(f/N)\leqq-0.093\times N+67.33.$$

7. A process cartridge which can be attached to and removed from the image forming apparatus of claim 1, comprising:

an image carrier configured to carry an electrostatic latent image;

at least one of a charging unit configured to electrify image carrier;

a condition detecting unit configured to detect a condition of the image forming apparatus and provide a detected condition of the image forming apparatus to a condition judging unit of the image forming apparatus; and a cleaner configured to remove a developer remained on the image carrier.

8. An image forming apparatus, comprising:

an image carrying means for carrying an electrostatic latent image;

a developing means for supplying a developer to make the electrostatic latent image visible;

a condition judging means for making a judgment about a condition of the developing device; and a voltage control means for supplying a combination of a DC voltage and a AC voltage as a developing bias voltage to the developing means and for changing the AC voltage according to the judgment so that a relation between a circumferential speed N of the developing means and a frequency f of the AC voltage is as follows:

$$-0.097\times N+61.17\leqq(f/N)\leqq-0.093\times N+67.33.$$

9. The image forming apparatus of claim 8, wherein the condition judging means makes the judgment based on a rotating condition of the developing means, and the voltage control means sets the relation between a circumferential speed N of the developing means and a frequency f of the AC voltage so that the following expression holds when the circumferential speed of the developing means according to the judgment is equal to or below a predetermined circumferential speed:

$$-0.097\times N+61.17\leqq(f/N)\leqq-0.093\times N+67.33.$$

10. The image forming apparatus of claim 8, wherein the condition judging means makes the judgment based on a consumption of the developer for supplying to the image carrying means, and the voltage control means sets the relation between a circumferential speed N of the developing means and a frequency f of the AC voltage so that the following expression holds when the consumption of the developer according to the judgment exceeds a predetermined threshold:

$$-0.097\times N+61.17\leqq(f/N)\leqq-0.093\times N+67.33.$$

11. The image forming apparatus of claim 8, wherein the condition judging means makes the judgment based on a completion of an operation of replenishing the developer with the image carrying means, and the voltage control means keeps the relation between a circumferential speed N of the developing means and a frequency f of the AC voltage set so that the following expression holds until a predetermined period elapses when the judgment stands for that the replenishing has been completed:

$$-0.097\times N+61.17\leqq(f/N)\leqq-0.093\times N+67.33.$$

12. The image forming apparatus of claim 8, wherein the condition judging means makes the judgment based on a humidity in a vicinity of the developing means, and the voltage control means sets the relation between a circumferential speed N of the developing means and a frequency f of the AC voltage so that the following expression holds when the humidity according to the judgment exceeds a predetermined threshold:

$$-0.097\times N+61.17\leqq(f/N)\leqq-0.093\times N+67.33.$$

13. The image forming apparatus of claim 8, wherein the condition judging means makes the judgment based on a condition of a power source in the image forming apparatus, and the voltage control means sets the relation between a circumferential speed N of the developing means and a frequency f of the AC voltage so that the following expression holds when the judgment stands for that the power source has been in OFF state for a predetermined period or a longer time:

$$-0.097\times N+61.17\leqq(f/N)\leqq-0.093\times N+67.33.$$

14. A process cartridge which can be attached to and removed from the image forming apparatus of claim 8, comprising:

an image carrying means for carrying an electrostatic latent image;

at least one of a charging unit for electrifying the image carrying means;

a condition detecting means for detecting a condition of the image forming apparatus and providing a detected condition of the image forming apparatus to a condition judging means of the image forming apparatus; and a cleaner for removing a developer remaining on the image carrier.

15. A developing method for a developing apparatus including an image carrier to carry an electrostatic latent image, a developing device to contain a developer and to have a developing roller to supply the developer to the image carrier to make the electrostatic latent image visible, and a voltage control unit to supply a combination of a DC voltage and a AC voltage as a developing bias voltage to the developing roller, comprising:

making a judgment about a condition of the developing device; and changing the AC voltage according to the judgment so that a relation between a circumferential speed N of the developing roller and a frequency f of the AC voltage is as follows:

$$-0.097\times N+61.17\leqq(f/N)\leqq-0.093\times N+67.33.$$

16. The developing method of claim 15, wherein the judgment is based on a rotating condition of the developing roller, and the relation between a circumferential speed N of the developing roller and a frequency f of the AC voltage is set so that the following expression holds when the circumferential speed of the developing roller according to the judgment is equal to or below a predetermined circumferential speed:

$$-0.097\times N+61.17\leqq(f/N)\leqq-0.093\times N+67.33.$$

17. The developing method of claim 15, wherein the judgment is based on a consumption of the developer, and the relation between a circumferential speed N of the developing roller and a frequency f of the AC voltage is set so that the following expression holds when the consumption of the developer according to the judgment exceeds a predetermined threshold:

$$-0.097\times N+61.17\leqq(f/N)\leqq-0.093\times N+67.33.$$

18. The developing method of claim 15, the judgment is based on a completion of an operation of a replenishment the developer with the developing device, and the relation between a circumferential speed N of the developing roller and a frequency f of the AC voltage is set so that the following expression holds until a predetermined period elapses when the judgment stands for that the replenishment has been completed:

$$-0.097\times N+61.17\leqq(f/N)\leqq-0.093\times N+67.33.$$

19. The developing method of claim 15, the judgment is based on a humidity in a vicinity of the developing device, and the relation between a circumferential speed N of the developing roller and a frequency f of the AC voltage is set so that the following expression holds when the judgment stands for that the humidity exceeds a predetermined threshold:

$$-0.097\times N+61.17\leqq(f/N)\leqq-0.093\times N+67.33.$$

20. The developing method of claim 15, the judgment is based on a condition of a power source in the developing apparatus, and the relation between a circumferential speed N of the developing roller and a frequency f of the AC voltage is set so that the following expression holds when the judgment stands for that the power source has been in OFF state for a predetermined period or a longer time:

$$-0.097\times N+61.17\leqq(f/N)\leqq-0.093\times N+67.33.$$

* * * * *